US006367787B1

(12) United States Patent
Poole et al.

(10) Patent No.: US 6,367,787 B1
(45) Date of Patent: Apr. 9, 2002

(54) HAND CLAMP

(75) Inventors: Daniel L. Poole; Robert N. Poole, both of Phoenix, AZ (US)

(73) Assignee: American Tool Companies, Inc., Hoffman Estates, IL (US)

( * ) Notice: Subject to any disclaimer, the term of this patent is extended or adjusted under 35 U.S.C. 154(b) by 0 days.

(21) Appl. No.: 09/516,355

(22) Filed: Mar. 1, 2000

Related U.S. Application Data

(60) Provisional application No. 60/122,468, filed on Mar. 1, 1999, and provisional application No. 60/124,818, filed on Mar. 17, 1999.

(51) Int. Cl.[7] ..... B25B 5/02

(52) U.S. Cl. ..... 269/6; 269/170; 269/166

(58) Field of Search ..... 269/6, 170, 166–171.5, 269/203, 204; 81/987, 487

(56) References Cited

U.S. PATENT DOCUMENTS

| | | | |
|---|---|---|---|
| 100,642 | A | 3/1870 | Lambert |
| 153,206 | A | 7/1874 | Van Wagoner |
| 226,617 | A | 4/1880 | Konig |
| 267,152 | A | 11/1882 | Cloud |
| 404,368 | A | 5/1889 | Stearns |
| 408,473 | A | 8/1889 | Focken |
| 410,815 | A | 9/1889 | Tarbell |
| 416,096 | A | 11/1889 | Dom |
| 491,633 | A | 2/1893 | Bourassa |
| 678,805 | A | 7/1901 | Weyland |

(List continued on next page.)

FOREIGN PATENT DOCUMENTS

| | | |
|---|---|---|
| DE | 1953994 | 5/1970 |
| DE | 198 61 130 A1 | 4/2000 |
| EP | 1 004 402 A2 | 11/1999 |
| WO | WO 99/04932 | 2/1999 |

OTHER PUBLICATIONS

"Pony Steel Bar Clamp Fixtures" styles 50, 52 and 56. Publication source and date unknown. It is believed that this publication was available to the public prior to Jul. 15, 1993.

Bessey Steel Bar Clamp Fixture RS 75 instructions. Publication source and date unknown. It is believed that this publication was available to the public prior to Jul. 15, 1993.

Advertisement for Bessey Bar Clamps Styles 52, 53 and 56. Publication source and date unknown. It is believed that this publication was available to the public prior to Jul. 15, 1993.

Advertisement for Bessey Bar Clamps Styles 43 and 45. Publication source and date unknown. It is believed that this publication was available to the public prior to Jul. 15, 1993.

Advertisement for Gross Stabil Clamp. Publication source and date unknown. It is believed that this publication was available to the public prior to Jul. 15, 1993.

(List continued on next page.)

*Primary Examiner*—Joseph J. Hail, III
*Assistant Examiner*—Lee Wilson
(74) *Attorney, Agent, or Firm*—Brinks Hofer Gilson & Lione

(57) ABSTRACT

A hand clamp includes a slide bar having a first jaw coupled to an end. A body having a jaw slidably receives the slide bar with the jaws in opposition. A drive assembly moves the slide bar in a single direction and includes a cavity formed in the body through which the slide bar extends. A driving lever is carried within the cavity to frictionally engage the slide bar and incrementally move it in the single direction. A braking lever is pivotally coupled to the body for movement into frictional engagement with the slide bar preventing the slide bar from moving in a direction opposite the single direction. A trigger handle is pivotally coupled to the body for moving the driving lever into and out of frictional engagement with the slide bar. A brake release is carried by the trigger handle for selectively engaging the braking lever.

20 Claims, 9 Drawing Sheets

U.S. PATENT DOCUMENTS

| | | | | | |
|---|---|---|---|---|---|
| 749,732 | A | | 1/1904 | Hanson et al. | |
| 757,166 | A | | 4/1904 | Wintsch | |
| 775,659 | A | | 11/1904 | Jorgensen | |
| 792,758 | A | | 6/1905 | Colt | |
| 838,514 | A | | 12/1906 | Baker | |
| 927,067 | A | | 7/1909 | Offineer | |
| 934,589 | A | | 9/1909 | Bradford | |
| 1,189,561 | A | | 7/1916 | Griminger | |
| 1,241,215 | A | | 9/1917 | Hoffman | |
| 1,340,092 | A | | 5/1920 | Tuscher, Jr. | |
| 1,393,766 | A | | 10/1921 | Du Charme | |
| 1,402,621 | A | | 1/1922 | Knittel et al. | |
| 1,445,344 | A | | 2/1923 | Moltrup | |
| 1,452,753 | A | | 4/1923 | Otto et al. | |
| 1,470,706 | A | | 10/1923 | Day | |
| 1,543,197 | A | | 6/1925 | Ulrich | |
| 1,551,328 | A | | 8/1925 | Perry | |
| 1,583,611 | A | | 5/1926 | Seely | |
| 1,639,561 | A | | 8/1927 | Hargrave | |
| 1,700,334 | A | | 1/1929 | Puterbaugh | |
| 1,772,428 | A | | 8/1930 | Palotce | |
| 1,783,713 | A | | 12/1930 | Holman | |
| 1,811,518 | A | | 6/1931 | Palmer | |
| 1,879,452 | A | | 9/1932 | Palotce | |
| 1,882,095 | A | | 10/1932 | Riggitts | |
| 1,890,042 | A | | 12/1932 | Morandi | |
| 1,944,116 | A | | 1/1934 | Stratman | |
| 2,133,892 | A | | 10/1938 | Gelinski | |
| 2,157,345 | A | | 5/1939 | Nelson | |
| 2,316,073 | A | | 4/1943 | Kellogg | |
| 2,386,570 | A | | 10/1945 | Petrie | |
| 2,468,358 | A | | 4/1949 | Clark | |
| 2,472,022 | A | | 5/1949 | Neal | |
| 2,539,865 | A | | 1/1951 | Sarvie | |
| 2,595,989 | A | | 5/1952 | Smeltz | |
| 2,602,358 | A | | 7/1952 | Lile | |
| 2,620,697 | A | | 12/1952 | Sarvie | |
| 2,656,864 | A | | 10/1953 | Hopfeld | |
| 2,701,487 | A | | 2/1955 | Ortman | |
| 2,781,803 | A | | 2/1957 | Nelson | |
| 2,815,053 | A | | 12/1957 | Walker | |
| 2,815,778 | A | | 12/1957 | Holman | |
| 2,923,334 | A | | 2/1960 | Brennan, Jr. | |
| 2,947,333 | A | | 8/1960 | Johnson | |
| 2,949,947 | A | | 8/1960 | Story | |
| 3,033,559 | A | | 5/1962 | Lindholm | |
| 3,159,393 | A | | 12/1964 | Villano | |
| 3,173,674 | A | | 3/1965 | Ringle | |
| 3,224,752 | A | | 12/1965 | Benbow | |
| 3,313,190 | A | | 4/1967 | Bothum | |
| 3,331,111 | A | | 7/1967 | Carver | |
| 3,575,405 | A | | 4/1971 | Harding | |
| 3,596,898 | A | | 8/1971 | Hilburn | |
| 3,608,404 | A | | 9/1971 | Sarvie | |
| D222,872 | S | | 1/1972 | Boucher | |
| D227,192 | S | | 6/1973 | Schafhauser | |
| 3,806,107 | A | | 4/1974 | Pitzer et al. | |
| 3,914,830 | A | | 10/1975 | Bolton | |
| D238,140 | S | | 12/1975 | Guimarin | |
| 3,933,346 | A | | 1/1976 | Carver | |
| 3,963,230 | A | | 6/1976 | Jankowski, Jr. | |
| 4,042,264 | A | | 8/1977 | Shumer | |
| 4,078,781 | A | | 3/1978 | Fraser et al. | |
| 4,083,548 | A | | 4/1978 | Hackbarth | |
| 4,088,313 | A | | 5/1978 | Pearson | |
| 4,132,397 | A | | 1/1979 | Ward | |
| 4,143,869 | A | | 3/1979 | Paterson et al. | |
| D259,327 | S | | 5/1981 | Sloane | |
| 4,306,710 | A | | 12/1981 | Vosper | |
| 4,339,113 | A | | 7/1982 | Vosper | |
| 4,381,105 | A | | 4/1983 | Goff et al. | |
| 4,538,485 | A | | 9/1985 | Saila | |
| 4,563,921 | A | | 1/1986 | Wallace | |
| D286,369 | S | | 10/1986 | Hahn | |
| 4,802,390 | A | | 2/1989 | Warheit | |
| 4,874,155 | A | | 10/1989 | Goul | |
| 4,893,801 | A | | 1/1990 | Flinn | |
| 4,926,722 | A | * | 5/1990 | Sorensen et al. | 269/6 |
| 4,989,847 | A | | 2/1991 | Chapman | |
| 5,005,449 | A | * | 4/1991 | Sorensen et al. | 269/6 |
| 5,009,134 | A | | 4/1991 | Sorensen et al. | |
| 5,022,137 | A | | 6/1991 | Sorensen et al. | |
| 5,094,131 | A | | 3/1992 | Sorensen et al. | |
| 5,096,170 | A | | 3/1992 | Albin | |
| 5,156,508 | A | | 10/1992 | Grisley | |
| 5,161,787 | A | | 11/1992 | Hobday | |
| 5,170,682 | A | | 12/1992 | Sorensen et al. | |
| D333,963 | S | | 3/1993 | Goodman | |
| 5,197,360 | A | * | 3/1993 | Wooster, Jr. | 269/170 |
| 5,222,420 | A | | 6/1993 | Sorensen et al. | |
| D340,632 | S | | 10/1993 | Easley | |
| D346,942 | S | | 5/1994 | Sawdon | |
| D348,816 | S | | 7/1994 | Degen | |
| 5,326,076 | A | | 7/1994 | Sorensen et al. | |
| 5,346,194 | A | | 9/1994 | Coffin | |
| D355,104 | S | | 2/1995 | Sorenson et al. | |
| 5,443,246 | A | | 8/1995 | Peterson | |
| 5,454,551 | A | | 10/1995 | Hobday | |
| D365,263 | S | | 12/1995 | Sorensen et al. | |
| 5,674,244 | A | | 10/1997 | Mathys | |
| 5,692,734 | A | | 12/1997 | Aldredge, Sr. | |
| 5,775,680 | A | | 7/1998 | Sorensen et al. | |
| 5,791,210 | A | | 8/1998 | Wolff et al. | |
| 5,826,310 | A | | 10/1998 | Hobday | |
| 5,853,168 | A | * | 12/1998 | Drake | 269/6 |
| D417,377 | S | | 12/1999 | Blank et al. | |
| D430,782 | S | | 9/2000 | Renner | |

OTHER PUBLICATIONS

"Pony Clamp Fixtures" styles 50, 52 and 56. Jorgensen Style 3500 Aluminum Bar Clamps. Jorgensen Style 7200 Steel I–Bar Clamps. Publication source and date unknown. It is believed that this publication was available to the public prior to Jul. 15, 1993.

* cited by examiner

HAND CLAMP

This application claims the benefit of U.S. Provisional Application No. 60/122,468 filed Mar. 1, 1999 and U.S. Provisional Application No. 60/124,818 filed Mar. 17, 1999.

FIELD OF THE INVENTION

This invention relates to hand tools.

More particularly the present invention relates to clamping devices.

In a further and more specific aspect, the present invention relates to clamping devices operable with one hand.

BACKGROUND OF THE INVENTION

Within the art of clamping devices, it is known to provide a clamp device including a slide bar slidably received through an aperture in a braking lever and held by a body. A driving lever operated by a pivoting trigger is carried by the body and operates to move the slide bar in a first direction. The braking lever prevents movement of the slide bar in the opposing direction. In this manner, a one hand operated clamp is partially provided.

While clamping effectively, the devices cannot be opened one handed. In other words, once the braking lever is disengaged and held in the disengaged position, an operator must move the sliding bar with the other hand. This is two handed operation which can become difficult if the other hand is otherwise occupied, such as with holding the item to be clamped. Furthermore, in these devices, the braking lever extends downward to a position spaced from and in front of the trigger. Thus, for operation, the operators finger or fingers must be removed from the trigger to engage the braking lever. On larger clamp devices, this arrangement can present a problem to individuals with small hands. Another problem is the recoil or snap of the braking lever upon release when an item is tightly clamped. This snap can actually be painful for the operator.

It would be highly advantageous, therefore, to remedy the foregoing and other deficiencies inherent in the prior art.

Accordingly, it is an object of the present invention to provide a new and improved hand clamp.

Another object of the present invention is to provide a hand clamp which can be opened and closed with one hand.

And another object of the present invention is to provide a hand clamp with the braking lever operable with the trigger.

Yet another object of the present invention is to provide a hand clamp having a drive mechanism which can selectively open or close the clamp.

A further object of the present invention is to provide a hand clamp in which the braking lever can be operated without a snap upon release.

SUMMARY OF THE INVENTION

Briefly, to achieve the desired objects of the present invention in accordance with a preferred embodiment thereof, provided is a hand clamp including a slide bar having a first end and a second end, a first jaw coupled to the first end and a body slidably receiving the slide bar. The body includes a second jaw opposing the first jaw. Also included in the hand clamp is a drive assembly for moving the slide bar in a single direction. The drive assembly includes a cavity formed in the body through which the slide bar extends. A driving lever is carried within the cavity and has an aperture through which the slide bar extends. The drive bar is movable between a first position providing substantially no frictional engagement with the slide bar and a second position frictionally engaging the slide bar and incrementally moving the slide bar in the single direction. A braking lever is provided having a first end pivotally coupled to the body and a second end. The braking lever is pivotable between a disengaged position substantially perpendicular to the slide bar and an engaged position wherein a frictional engagement occurs between the braking lever and the slide bar preventing the slide bar from moving in a direction opposite the single direction. A trigger handle is pivotally coupled to the body and engages the driving lever for moving the driving lever between the first position and the second position. A brake release is carried by the trigger handle and has an engagement end and an activation end. The brake release is movable between an engaged position in which the engagement end engages the second end of the braking lever and a disengaged position in which the engagement end does not engage the second end of the braking lever. Movement of the trigger handle with the brake release in the engaged position moves the braking lever to the disengaged position. Movement of the trigger handle with the brake release in the disengaged position does not effect the braking lever.

BRIEF DESCRIPTION OF THE DRAWINGS

Specific objects and advantages of the invention will become readily apparent to those skilled in the art from the following detailed description of preferred embodiments taken in conjunction with the drawings, in which.

DETAILED DESCRIPTION OF THE PREFERRED EMBODIMENTS

Figure 1:
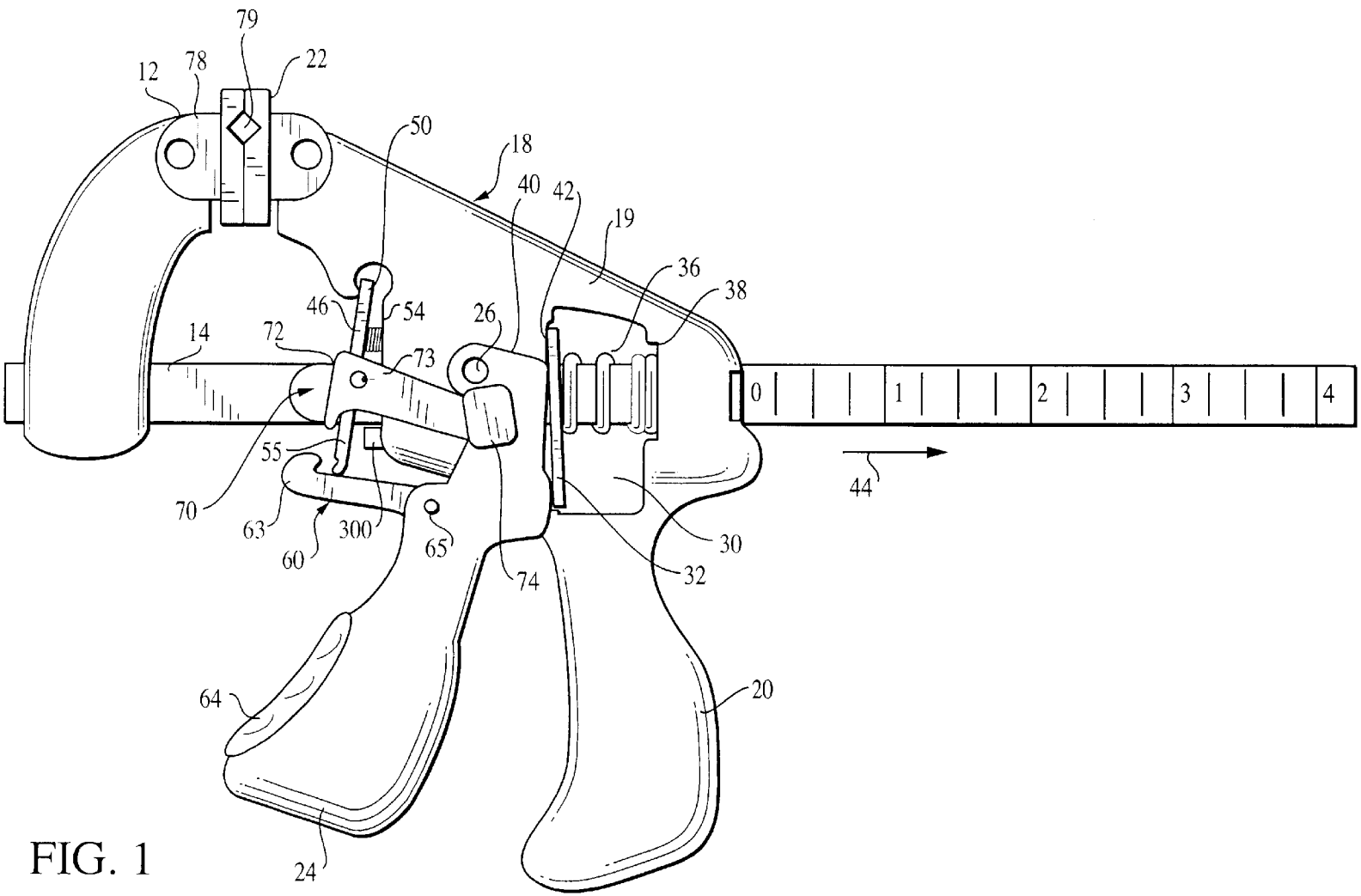
FIG. 1 is a side view illustrating a hand clamp of the present invention.

Turning now to the drawings in which like reference characters indicate corresponding elements throughout the several views, attention is first directed to FIG. 1 which illustrates a hand clamp generally designated 10. Hand clamp 10 is substantially similar to the device disclosed in U.S. Pat. No. 4,926,722, entitled "Quick Action Bar Clamp" herein incorporated by reference.

Hand clamp 10 includes a jaw 12 connected to an end of a slide bar 14. A grip assembly 18 slidably supports slide bar 14. Grip assembly 18 includes a body 19 through which slide bar 14 passes, a hand grip 20 extending from body 19 and a jaw 22 attached to body 19, opposing jaw 12. A trigger handle 24 is pivotally coupled to body 19 by a pivot pin 26 and configured to be received about hand grip 20. A drive assembly includes a cavity 30 formed in body 19 through which slide bar 14 passes. Slide bar 14 passes through an aperture formed in a driving lever 32 carried within cavity 30. The drive assembly further includes a spring 36 compressible between driving lever 32 and a surface 38 of cavity 30. Spring 36 urges driving lever 32 against an upper end 40 of trigger handle 24. Upper end 40 of trigger handle 24 is bifurcated to straddle slide bar 14. Spring 36 urges driving lever 32 against inner surface 42 of body 19 providing a standby condition. In the standby condition, driving lever 32 is positioned generally perpendicular to the direction of motion, indicated by an arrowed line 44, of slide bar 14 when in operation, providing no frictional engagement between driving lever 32 and slide bar 14. Any motion of trigger handle 24 about pivot pin 26 in the direction of arrowed line 44 is accomplished against the bias of spring 36.

Slide bar 14 passes through an aperture formed in a braking lever 46. An end 50 of braking lever 46 is pivotally captured by body 19 such that braking lever 46 is pivotable between a position substantially perpendicular to slide bar 14 and a position wherein a frictional engagement occurs between braking lever 46 and slide bar 14. A spring 54 is carried between body 19 and braking lever 46, biasing a free end 55 of braking lever 46 away from body 19 and trigger handle 24, and forcing braking lever 46 into the position wherein a frictional engagement occurs between braking lever 46 and slide bar 14.

Thus, in operation, as trigger handle 24 is pivoted toward hand grip 20, driving lever 32 is moved from the standby position, in which it is substantially perpendicular to the longitudinal axis of slide bar 14, to a position in which it frictionally engages slide bar 14 and incrementally urges jaw 12 towards jaw 22. Because braking lever 46 is free to pivot against the bias of spring 54 when force is applied to slide bar 14 by trigger handle 24, braking lever 46 presents no obstacle to this motion of slide bar 14. However, if a force is applied to slide bar 14 in the direction opposite to the direction indicated by arrowed line 44, braking lever 46 remains in the position in which it frictionally engages slide bar 14 preventing movement thereof.

Figure 2:
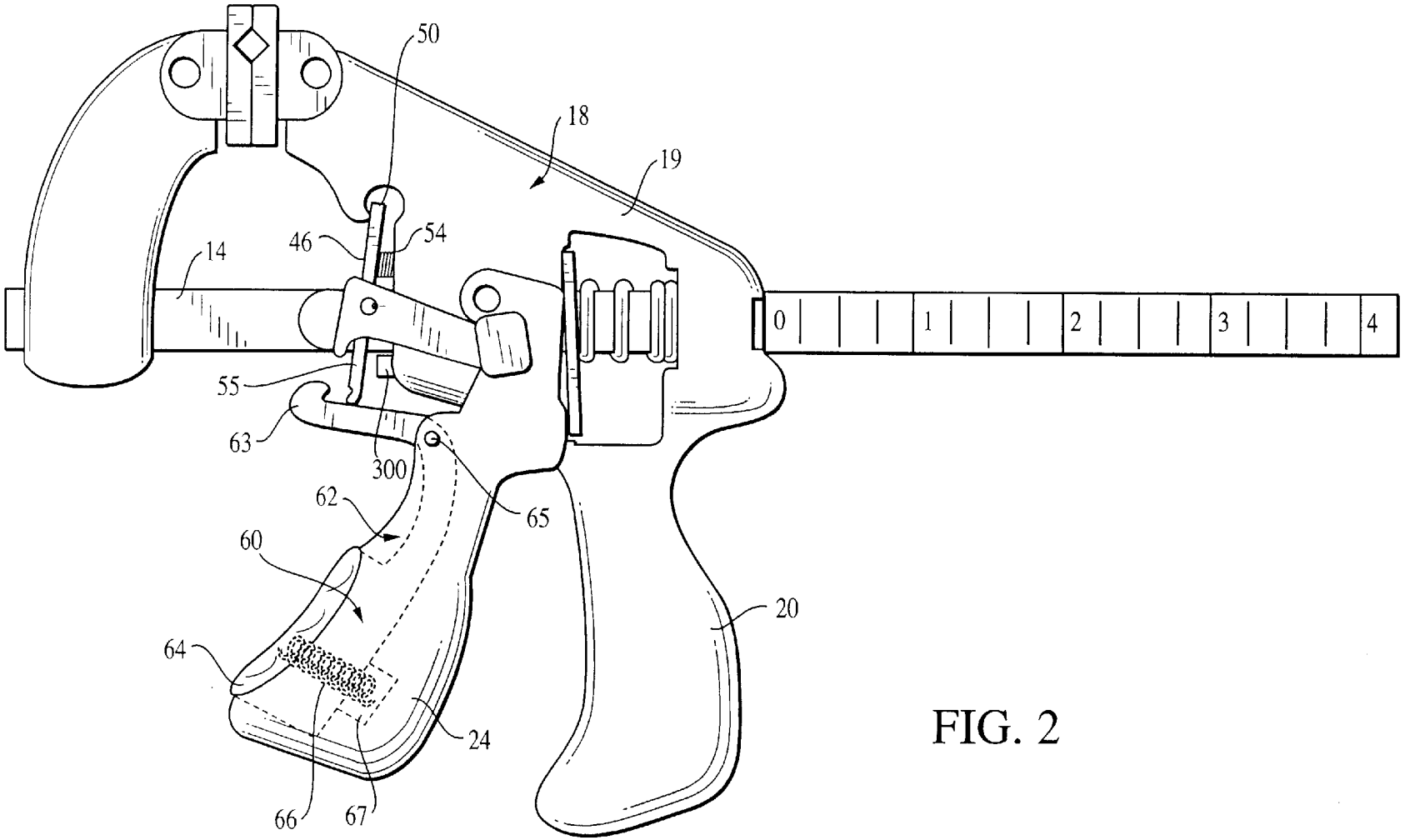
FIG. 2 is a side view of the hand clamp of FIG. 1 illustrating a brake release mechanism.

To permit withdrawal of slide bar 14 from body 19 thereby expanding the distance between jaw 12 and jaw 22, braking lever 46 must be moved against the bias of spring 54. In this manner, braking lever 46 is moved to the substantially perpendicular position wherein frictional engagement between braking lever 46 and slide bar 14 is removed. This is accomplished by providing a brake release 60 carried by trigger handle 24. In this specific embodiment, trigger handle 24 includes an interior cavity 62 best seen in FIG. 2. Brake release 60 includes an engagement end 63 and an activation end 64 generally forming a 90 degree angle in relation to one another, with a pivot point 65 located at the bend. Engagement end 63 extends substantially perpendicularly from trigger handle 24 and is configured to engage free end 55 of braking lever 46. Brake release 60 is movable between an engaged position in which braking lever 46 is engaged by engagement end 63 and a disengaged position in which braking lever 46 is not engaged. A compression spring 66 is captured between activation end 64 and an interior wall 67 of cavity 62. Compression spring 66 biases activation end 64 away from trigger handle 24 into the engaged position, pivoting engagement end 63 upward into engagement with free end 55 of braking lever 46. Activation end 64 must be moved against the bias of compression spring 66 to move brake release 60 into the disengaged position.

Figure 3:
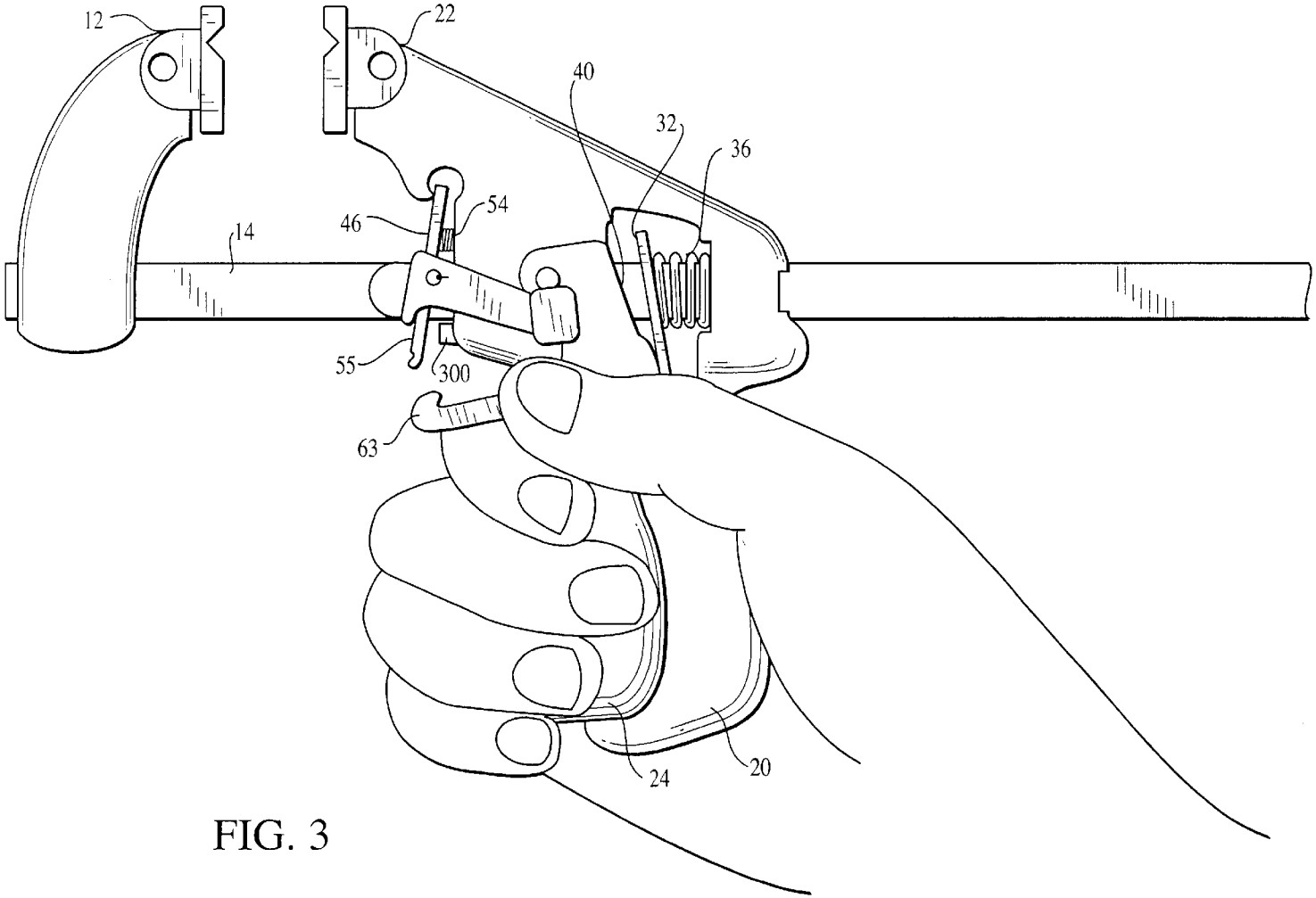
FIG. 3 is a side view of the hand clamp of FIGS. 1 and 2 as it would appear with clamping portions closed.

Turning now to FIG. 3, the trigger handle 24 has been moved back to towards grip 20. While not visible, the gripping hand compresses activation end 64 against the bias of spring 66 during the pivotal movement of trigger handle 24 towards grip 20. Thus, as can be seen, engagement end 63 is disengaged from free end 55 of braking lever 46.

Figure 4:
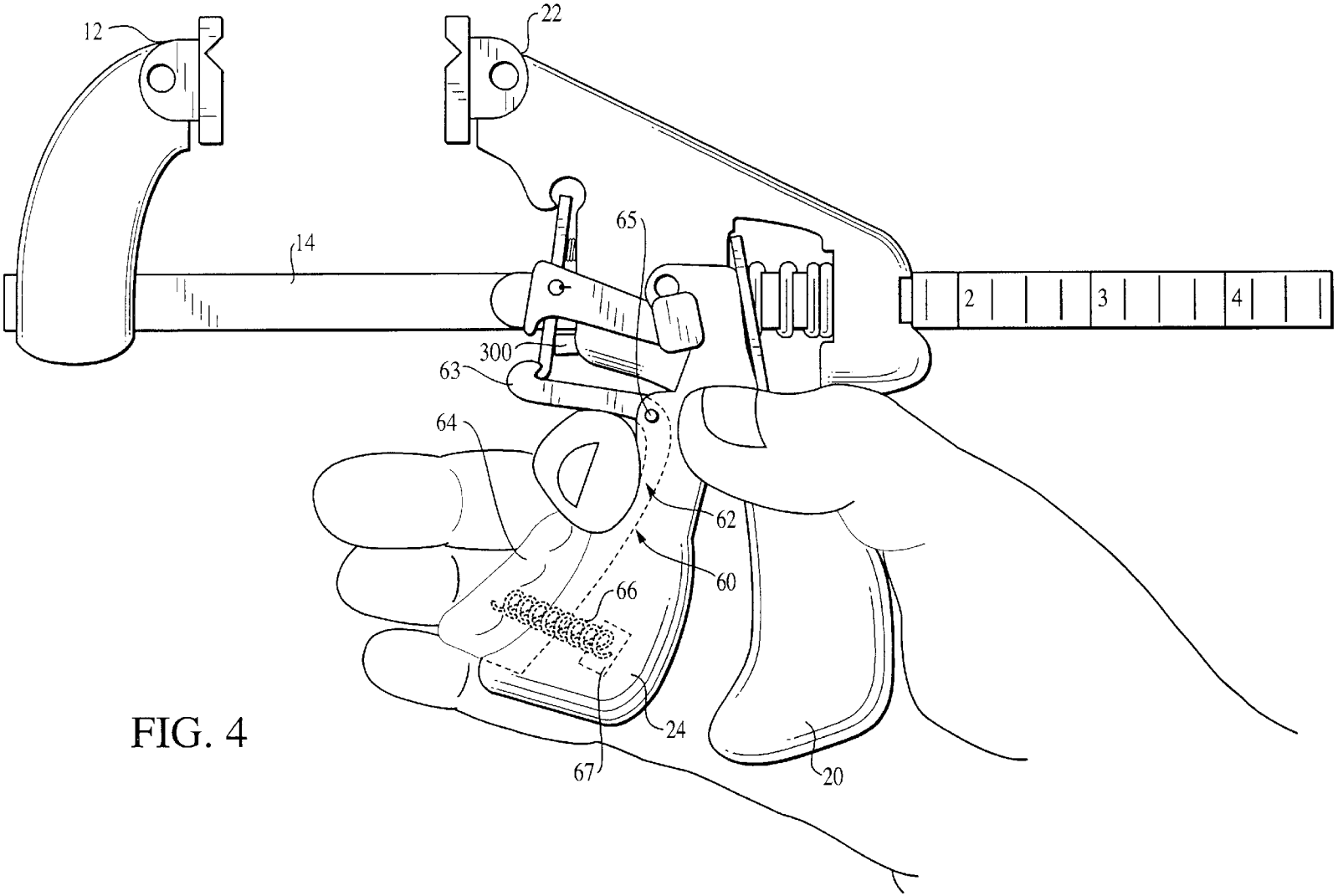
FIG. 4 is a side view of the hand clamp of FIG. 1 as it would appear with the brake release mechanism of FIG. 2 being activated to release the braking lever.

Referring not to FIG. 4, to permit release of the clamp, or in other words, to permit movement of slide bar 14 in a direction opposite arrowed line 44, braking lever 46 must be moved to the substantially perpendicular position against the bias of spring 54 wherein there is no frictional engagement with slide bar 14. This is accomplished by releasing contact by the operating hand with activation end 64 to permit compression spring 66 to bias brake release 60 into the engagement position. Trigger handle 24 is then moved back towards grip 20. Since engagement end 63 engages free end 55 of braking lever 46, movement of trigger handle 24 toward grip 20 moves braking lever 46 against the bias of spring 54 to the substantially perpendicular position wherein there is no frictional engagement with slide bar 14.

Still referring to FIG. 1, an additional element may be added to hand clamp 10 to facilitate backup of jaw 12. Backup assembly 70 includes a backup lever 72 having an aperture for receiving slide bar 14 therethrough, side extensions 73 extending back towards grip 20 from backup lever 72 on either side of slide bar 14 and terminating in thumb tabs 74, and a spring 75 couple between side extensions 73 and body 19. Backup assembly 70 is movable between a position in which backup lever 72 frictionally engages slide bar 14 and a position wherein backup lever 72 does not frictionally engages slide bar 14.

Figure 5:
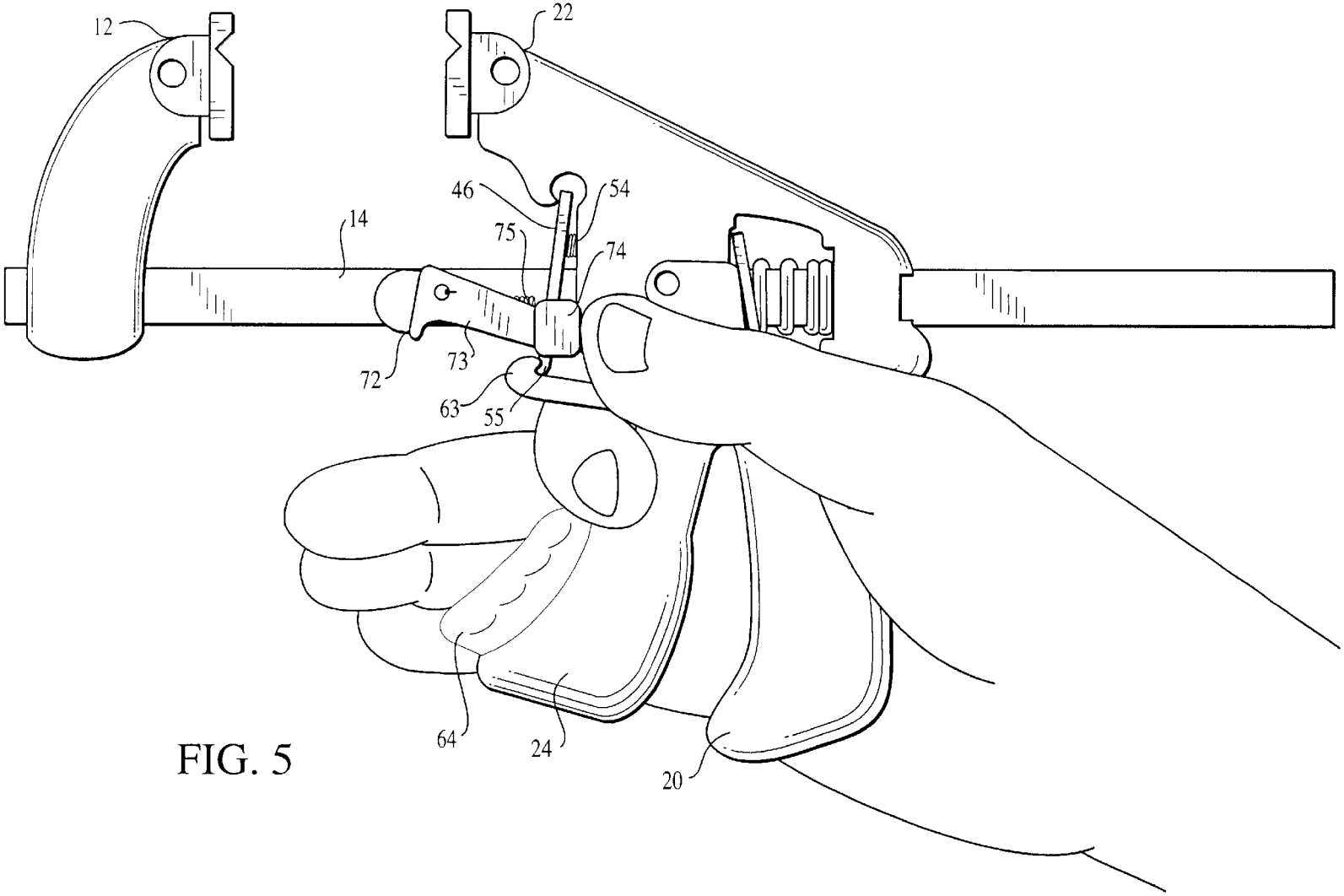
FIG. 5 is a side view of the hand clamp of FIG. 1 with the backing assembly being operated.

With additional reference to FIG. 5, in operation, an individual engages one of thumb tabs 74 forcing backup lever 72 into frictional engagement with slide bar 14 against the bias out of spring 75. When backup lever 72 is in frictional engagement with slide bar 14, pushing outward on thumb tabs 74 incrementally moves slide bar 14. When released, backup assembly 70 is returned to its original position by springs 75. In this manner, when braking lever 46 is moved into the substantially perpendicular position in which it does not frictionally engage slide bar 14, an individual may backup, or in other words increase the distance between jaw 12 and jaw 22 by operating backup assembly 70. When moved into the substantially perpendicular position to release the clamp, braking lever 46 snaps forcefully rearward toward body 19 in response to the tension on the clamp when in a clamped condition. This can cause pain in the hand of the user holding hand clamp 10. To alleviate this pain, body 19 supports a bumper 300 that opposes braking lever 46 (FIGS. 1–4). As shown in FIG. 4, braking lever 46 snaps against bumper 300 when moved into its substantially perpendicular position to release clamp. Bumper 300 is constructed of rubber or other selected elastomer or the like and absorbs the shock when braking lever 46 snaps preventing pain in the hand of the user. While the elastomeric material absorbs some of the shock, much of the shock is prevented from building by limiting the range of movement of the braking lever. Thus, bumper 300 can be a non-elastic material which extends outward to reduce the travel of braking lever 46.

Figure 6A:
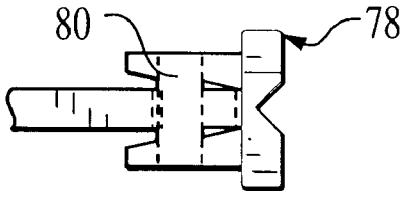
FIGS. 6A–B are partial top views of the pivotal engagement elements of the clamp jaws.
Figure 6B:
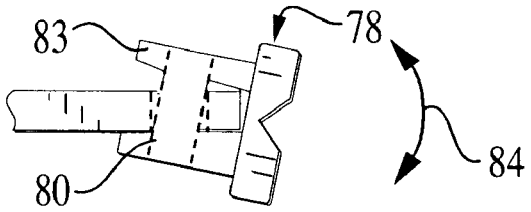
Figure 6C:
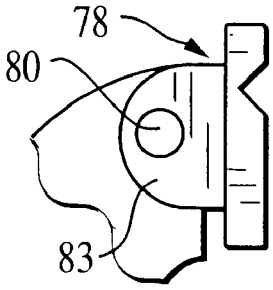
FIGS. 6C–D are partial side views of the pivotal engagement elements of the clamp jaws.
Figure 6D:
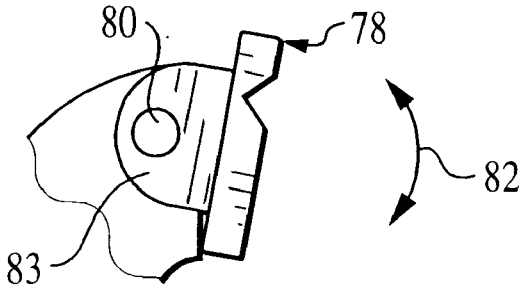

Additional features which can be seen in FIGS. 1 and 6A–D include horizontal and vertical pivoting of engagement elements 78 of jaws 12 and 22. Engagement elements 78 further include horizontal and vertical grooves 79 formed in a surface thereof to permit the secure retention of tubular objects. To permit accurate spacing of jaws 12 and 22, indicia may be added to slide bar 14 indicating distance of separation therebetween. Referring specifically to FIGS. 6C–6D, engagement elements 78 are bifurcated with furcations 83 extending on either side of jaws 12 and 22. Engagement elements 78 are coupled to jaws 12 and 22 by pins 80 extending through furcations 83, permitting vertical movement as illustrated by double arrowed line 82. In addition, with specific reference to FIGS. 6A and 6B, horizontal or side to side movement is permitted by a beveled shape of the inner surface of furcations 83, as illustrated by double arrowed line 84.

Figure 7:
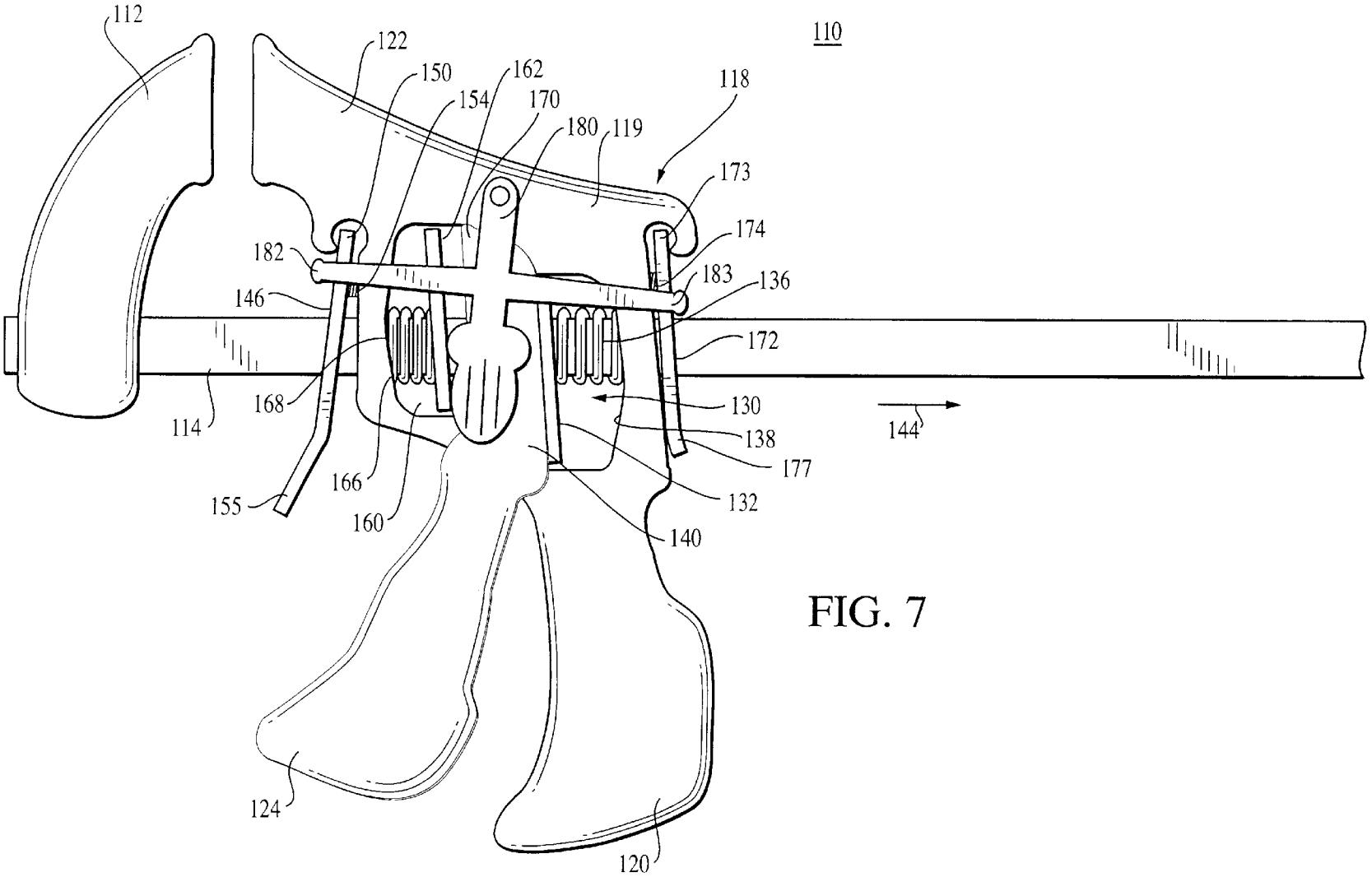
FIG. 7 is a side view of another embodiment of a hand clamp according to the present invention.
Figure 8:
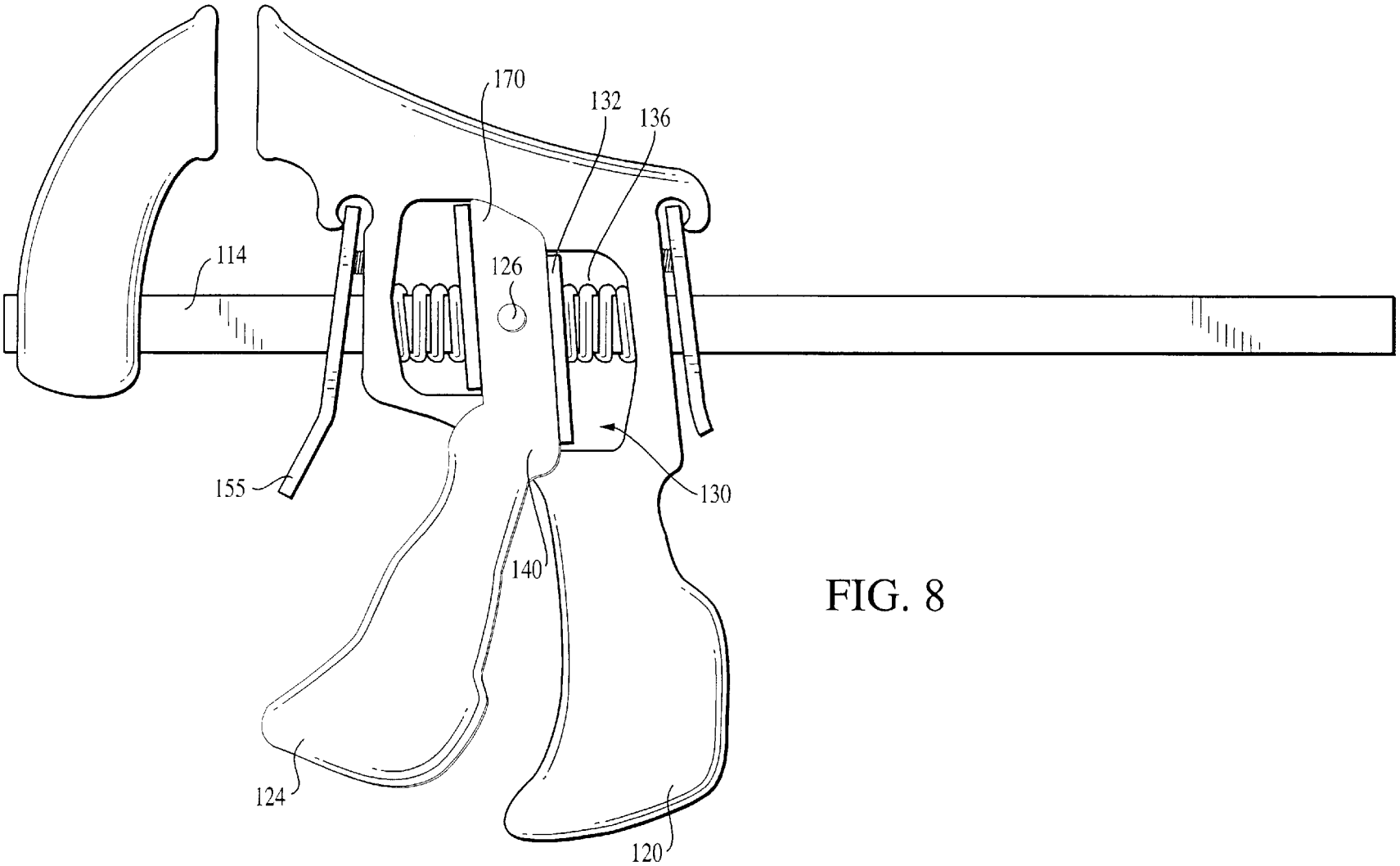
FIG. 8 is a side view of the hand clamp of FIG. 7 with the selector switch removed.

Turning now to FIGS. 7 and 8, another embodiment of a hand clamp, generally designated 110, is illustrated. Hand clamp 110 is capable of being closed as the previous embodiment, and further capable of being opened in the same manner. Hand clamp 110 includes a jaw 112 connected to an end of a slide bar 114. A grip assembly 118 slidably supports slide bar 114. Grip assembly 118 includes a body 119 through which slide bar 114 passes, a hand grip 120 extending from body 119 and a jaw 122 attached to body 119, opposing jaw 112. A trigger handle 124 is pivotally coupled to body 119 by a pivot pin 126 and configured to be received about hand grip 120. A clamping drive assembly includes a cavity 130 formed in body 119 through which slide bar 114 passes. Slide bar 114 passes through an aperture formed in a clamping driving lever 132 carried within cavity 130. The clamping drive assembly further includes a spring 136 compressible between clamping driving lever 132 and a surface 138 of cavity 130. Spring 136 urges clamping driving lever 132 against a portion 140 of trigger handle 124. Portion 140 of trigger handle 124 is bifurcated to straddle slide bar 114. Spring 136 urges clamping driving lever 132 against inner surface 142 of body 119 providing a standby condition. In the standby condition, clamping driving lever 132 is positioned generally perpendicular to the direction of motion, indicated by an arrowed line 144, of slide bar 114 when in operation, providing no frictional engagement between driving lever 132 and slide bar 114. Any motion of trigger handle 124 about pivot pin 126 in the direction of arrowed line 144 is accomplished against the bias of spring 136.

Slide bar 114 passes through an aperture formed in a braking lever 146 mounted forward of body 119. An end 150 of braking lever 146 is pivotally captured by body 119 such that braking lever 146 is pivotable between a position substantially perpendicular to slide bar 114 and a position wherein a frictional engagement occurs between braking lever 146 and slide bar 114. A spring 154 is carried between body 119 and braking lever 146, biasing a free end 155 of braking lever 146 away from body 119 and trigger handle 124, and forcing braking lever 146 into the position wherein a frictional engagement occurs between braking lever 146 and slide bar 114.

Additionally, a spreading drive assembly is also provided for moving jaws 112 and 122 apart. The spreading drive assembly includes a cavity 160 formed in body 119 forward of cavity 130, through which slide bar 114 passes. Slide bar 114 passes through an aperture formed in a spreading driving lever 162 carried within cavity 160. The spreading drive assembly further includes a spring 166 compressible between spreading driving lever 162 and a surface 168 of cavity 160. Spring 166 urges spreading driving lever 132 against a portion 170 of trigger handle 124. Spring 166 urges spreading driving lever 162 into a standby condition. In the standby condition, spreading driving lever 162 is positioned generally perpendicular to the direction of motion, indicated by an arrowed line 144, of slide bar 114 when in operation, providing no frictional engagement between driving lever 162 and slide bar 114.

Slide bar 114 passes through an aperture formed in a braking lever 172 mounted rearward of body 119. An end 173 of braking lever 172 is pivotally captured by body 119 such that braking lever 172 is pivotable between a position substantially perpendicular to slide bar 114 and a position wherein a frictional engagement occurs between braking lever 172 and slide bar 114. A spring 174 is carried between body 119 and braking lever 172, biasing a free end 177 of braking lever 172 away from body 119 and trigger handle 124, and forcing braking lever 172 into the position wherein a frictional engagement occurs between braking lever 172 and slide bar 114.

Thus, in operation, in order to prevent conflict between the drive assembly, a selector switch 180 is provided. Switch 180 is pivotally coupled to body 119 and is movable between a clamping position and a spreading position. A locking mechanism may be provided for holding switch 180 in the clamping position and the spreading position. Selector switch 180 is in the clamping position in FIG. 7. Selector switch 180 includes arms 182 and 183 extending therefrom and coupled to braking levers 146 and 172 respectively. In the clamping position, arm 183 compresses braking lever 172 against the bias of spring 174 eliminating the frictional engagement between braking lever 172 and sliding bar 114. Concurrently, selector switch 180 engages spreading drive lever 162 forcing it forward against the bias of spring 16 while maintaining its non-frictional engagement with sliding bar 114. In this manner, when trigger handle 124 is moved rearward toward grip 120, portion 170 will not engage spreading drive lever 162. In effect, selector switch 180 disengages the spreading drive assembly and braking lever 172 permitting operation of clamp 110 in a manner similar to the previous embodiment. By moving selector switch 180 into the spreading position, arm 182 moves braking lever 146 into a non-frictional engagement with sliding bar 114 and disengages the clamping drive mechanism by forcing clamping drive lever 132 forward against the bias of spring 136 while maintaining its non-frictional engagement with sliding bar 114. Thus, by using selector switch 180, one of the spreading drive mechanism and the clamping drive mechanism is disabled permitting use of the other.

Figures 9, 10:
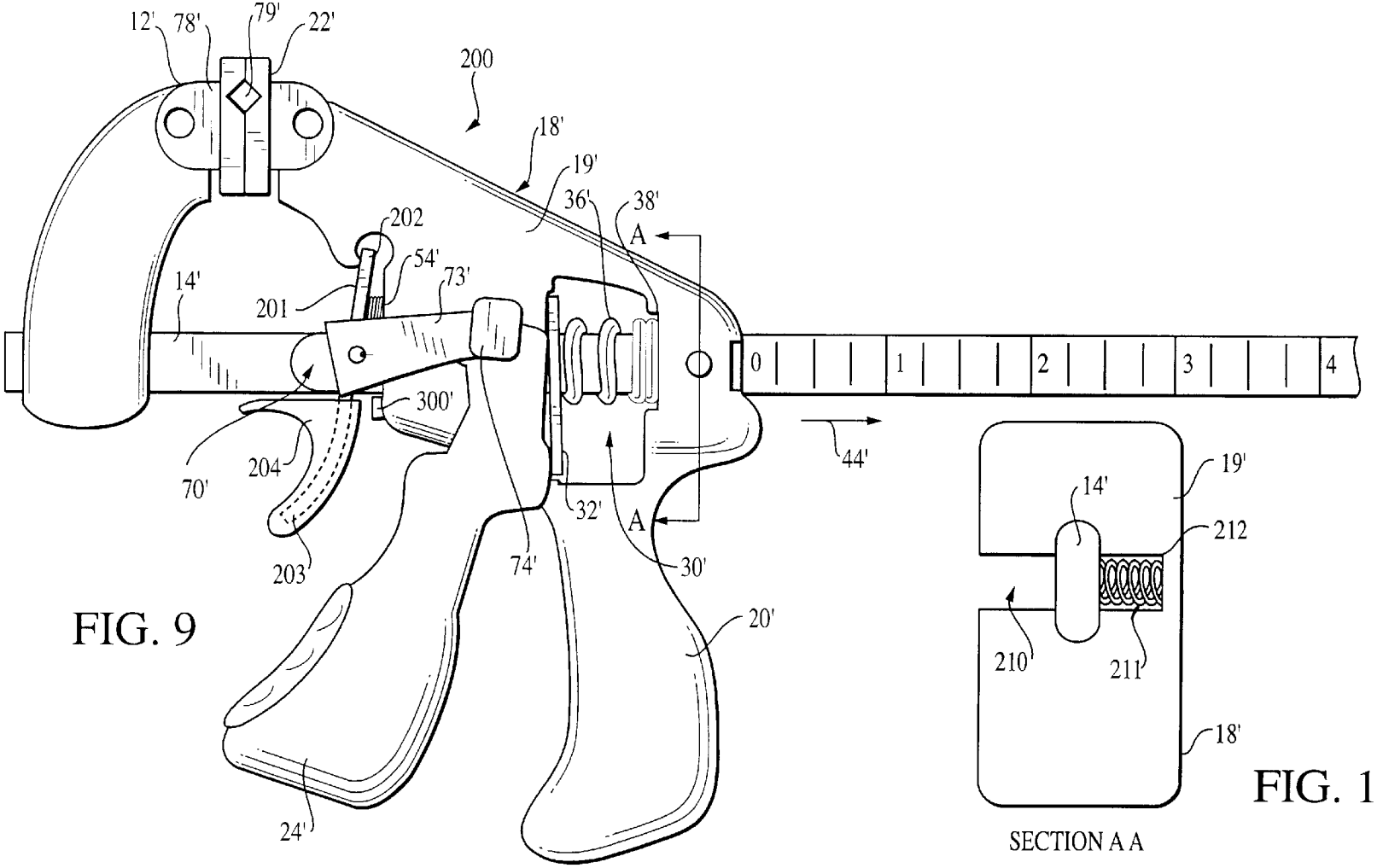
FIG. 9 is a side view illustrating a hand clamp in accordance with an alternate embodiment of the present invention.
FIG. 10 is a sectional view taken along line A—A of FIG. 9.

Turning to FIG. 9, provided is a side view illustrating a hand clamp 200 in accordance with an alternate embodiment of the present invention. Hand clamp 200 is similar to hand clamp 10. Accordingly, the same reference characters used to describe hand clamp 10 will also be used to describe hand clamp 200 to the extent of their structural similarities. For the purpose of clarity, common reference characters used to describe hand clamp 200 will include a prime ("') symbol. In this regard, hand clamp 200 includes jaw 12', slide bar 14', grip assembly 18' including body 19' through which slide bar 14' passes, hand grip 20' extending from body 19' and jaw 22' attached to body 19', opposing jaw 12'. Trigger handle 24' is pivotally coupled to body 19' by a pivot pin 26' and configured to be received about hand grip 20'. A drive assembly includes cavity 30' formed in body 19' through which slide bar 14' passes. Slide bar 14' passes through an aperture formed in driving lever 32' carried within cavity 30'. The drive assembly further includes spring 36' compressible between driving lever 32' and surface 38' of cavity 30'. Spring 36' urges driving lever 32' against upper end 40' of trigger handle 24'. Upper end 40' of trigger handle 24' is bifurcated to straddle slide bar 14'. Spring 36' urges driving lever 32' against inner surface 42' of body 19' providing a standby condition. In the standby condition, driving lever 32' is positioned generally perpendicular to the direction of motion, indicated by an arrowed line 44', of slide bar 14' when in operation, providing no frictional engagement between driving lever 32' and slide bar 14'. Any motion of trigger handle 24' about pivot pin 26' in the direction of arrowed line 44' is accomplished against the bias of spring 36'.

Slide bar 14' passes through an aperture formed in a braking lever 201. An end 202 of braking lever 201 is pivotally captured by body 19' such that braking lever 201 is pivotable between a position substantially perpendicular to slide bar 14' and a position wherein a frictional engagement occurs between braking lever 201 and slide bar 14. Spring 54' is carried between body 19' and braking lever 201, biasing a free end 203 of braking lever 201 away from body 19' and trigger handle 24', and forcing braking lever 201 into the position wherein a frictional engagement occurs between braking lever 201 and slide bar 14'.

Thus, in operation, as trigger handle 24' is pivoted toward hand grip 20', driving lever 32 is moved from the standby position, in which it is substantially perpendicular to the longitudinal axis of slide bar 14', to a position in which it frictionally engages slide bar 14' and incrementally urges jaw 12' toward jaw 22'. Because braking lever 201 is free to pivot against the bias of spring 54' when force is applied to slide bar 14' by trigger handle 24', braking lever 201 presents no obstacle to this motion of slide bar 14'. However, if a force is applied to slide bar 14' in the direction opposite to the direction indicated by arrowed line 44', braking lever 201 remains in the position in which it frictionally engages slide bar 14' preventing movement thereof.

When moved into the substantially perpendicular position to release the clamp, braking lever 201 snaps forcefully rearward toward body 19' in response to the tension on the clamp when in a clamped condition. This can cause pain in the hand of the user holding hand clamp 200. To alleviate this pain, body 19' also includes bumper 300' that opposes braking lever 201. Braking lever 201 snaps against bumper 300' when moved into its substantially perpendicular position to release clamp. Bumper 300' is constructed of the material of body 19' or may be an insert of various material which may include rubber or other selected elastomer or the like and absorbs the shock when braking lever 201 snaps preventing pain in the hand or finger/fingers of the user.

To permit withdrawal of slide bar 14' from body 19' thereby expanding the distance between jaw 12' and jaw 22', braking lever 201 must be moved against the bias of spring 54'. Braking lever 201 carries a grip 204 at free end 203 for accommodating at least one finger of a hand gripping hand grip 20'. Grip 204 may be constructed of rubber, foam, plastic, etc. In this manner, braking lever 201 is moved to the substantially perpendicular position wherein frictional engagement between braking lever 201 and slide bar 14' is removed. With, for instance, hand grip 20' held by the hand of a user, this is accomplished by the user seating at least one finger with grip 204 and with this finger, pulling free end 203 to move braking lever 201 against the bias of spring 54'. Grip 204 includes a shield portion which keeps the finger or fingers from hitting the back off mechanism. Furthermore, grip 204 is preferably soft to prevent the finger or fingers seated thereagainst from being hurt when the braking lever 201 is pulled. Although braking lever 201 is shown extending downwardly adjacent trigger handle 24', it may be located elsewhere along the extent of hand clamp 200 without departing from the invention.

Turning to FIG. 10, body 19' of grip assembly 18 includes a blind bore 210 that slide bar 14' traverses as it passes through body 19'. The blind bore 210 is located next to surface 38' adjacent hand grip 20', but it may be located adjacent trigger handle 24' if desired. A compression spring 211 is captured between slide bar 14' and the closed end 212 of blind bore 210 and normally biases against slide bar 14' which puts tension on the slide bar 14' preventing it from falling out of body 19' when released. Other biasing mechanisms other than compression spring 210 may be used for normally exerting tension against slide bar 14' such as a rubber, elastomeric or other form of resilient member and the like.

Various changes and modifications to the embodiments herein chosen for purposes of illustration will readily occur to those skilled in the art. To the extent that such modifications and variations do not depart from the spirit of the invention, they are intended to be included within the scope thereof.

What is claimed is:

1. A hand clamp comprising:

a slide bar having a first end and a second end;

a first jaw coupled to the first end;

a body slidably receiving the slide bar, the body including a second jaw opposing the first jaw;

a drive assembly for moving the slide bar in a single direction, the drive assembly including:

a cavity formed in the body through which the slide bar extends;

a driving lever carried within the cavity and having an aperture through which the slide bar extends, the drive bar movable between a first position providing substantially no frictional engagement with the slide bar and a second position frictionally engaging the slide bar and incrementally moving the slide bar in the single direction; and a braking lever having a first end pivotally coupled to the body and a second end, the braking lever being pivotable between a disengaged position substantially perpendicular to the slide bar and an engaged position wherein a frictional engagement occurs between the braking lever and the slide bar preventing the slide bar from moving in a direction opposite the single direction;

a trigger handle pivotally coupled to the body and engaging the driving lever for moving the driving lever between the first position and the second position; and a brake release carried by the trigger handle and having an engagement end and an activation end, the brake release movable between an engaged position in which the engagement end engages the second end of the braking lever and a disengaged position in which the engagement end does not engage the second end of the braking lever, movement of the trigger handle with the brake release in the engaged position moves the braking lever to the disengaged position, movement of the trigger handle with the brake release in the disengaged position does not effect the braking lever.

2. A hand clamp as claimed in claim 1 wherein the brake release is angled about a pivot point, the pivot point pivotally attached to the trigger handle and movable between the engaged position and the disengaged position.

3. A hand clamp as claimed in claim 2 wherein the activation end projects beyond the trigger handle with the brake release in the engaged position and is moved inward of the trigger handle to move the brake release to the disengaged position.

4. A hand clamp as claimed in claim 3 further comprising a biasing member captured between the activation end and an interior wall of the trigger handle to bias the activation end away from the trigger handle into the engaged position.

5. A hand clamp as claimed in claim 1 further comprising a reversing mechanism for moving the slide bar in the opposing direction.

6. A hand clamp as claimed in claim 5 wherein the reversing mechanism includes a backup lever positioned forward of the braking lever and having an aperture for receiving the slide bar 14 therethrough, the backup lever being movable between a position in which the backup lever frictionally engages the slide bar and a position wherein the backup lever does not frictionally engage the slide bar.

7. A hand clamp as claimed in claim 6 wherein the reversing mechanism further includes side extensions terminating in thumb tabs extending back towards the body on either side of the slide bar, and springs coupled between the side extensions and the body.

8. A hand clamp as claimed in claim 5 wherein the reversing mechanism comprises a second drive assembly for moving the slide bar in the opposing direction, the drive assembly including:

a second cavity formed in the body through which the slide bar extends;

a second driving lever carried within the second cavity and having an aperture through which the slide bar extends, the second driving lever movable between a first position providing substantially no frictional engagement with the slide bar and a second position frictionally engaging the slide bar and incrementally moving the slide bar in the opposing direction;

a second braking lever having a first end pivotally coupled to the body and a second end, the second braking lever being pivotable between a disengaged position substantially perpendicular to the slide bar and an engaged position wherein a frictional engagement occurs between the second braking lever and the slide bar preventing the slide bar from moving in the single direction.

9. A hand clamp as claimed in claim 8 where in the reversing mechanism further includes a selector switch having a first position in which the second braking lever is moved to the disengaged position and the second driving lever is moved from frictional engagement with the slide bar, and a second position in which the braking lever is moved to the disengaged position and the driving lever is moved from frictional engagement with the slide bar.

10. A hand clamp comprising:

a slide bar having a first end and a second end;

a first jaw coupled to the first end;

a body slidably receiving the slide bar, the body including a second jaw opposing the first jaw;

a drive assembly for moving the slide bar in a single direction, the drive assembly including:

a cavity formed in the body through which the slide bar extends;

a driving lever carried within the cavity and having an aperture through which the slide bar extends, the drive bar movable between a first position providing substantially no frictional engagement with the slide bar and a second position frictionally engaging the slide bar and incrementally moving the slide bar in the single direction;

a trigger handle pivotally coupled to the body and engaging the driving lever for moving the driving lever between the first position and the second position;

a braking lever having a first end pivotally coupled to the body, the braking lever being pivotable between a disengaged position substantially perpendicular to the slide bar and an engaged position wherein a frictional engagement occurs between the braking lever and the slide bar, preventing the slide bar from moving in a direction opposite the single direction; and a bumper carried by the body to reduce the travel of the braking lever between the engaged position and the disengaged position.

11. A hand clamp as claimed in claim 10 further comprising a brake release carried by the trigger handle and having an engagement end and an activation end, the brake release movable between an engaged position in which the engagement end engages the second end of the braking lever and a disengaged position in which the engagement end does not engage the second end of the braking lever, movement of the trigger handle with the brake release in the engaged position moves the braking lever to the disengaged position, movement of the trigger handle with the brake release in the disengaged position does not effect the braking lever.

12. A hand clamp as claimed in claim 11 wherein the brake release is angled about a pivot point, the pivot point pivotally attached to the trigger handle and movable between the engaged position and the disengaged position.

13. A hand clamp as claimed in claim 12 wherein the activation end projects beyond the trigger handle with the brake release in the engaged position and is moved inward of the trigger handle to move the brake release to the disengaged position.

14. A hand clamp as claimed in claim 13 further comprising a biasing member captured between the activation end and an interior wall of the trigger handle to bias the activation end away from the trigger handle into the engaged position.

15. A hand clamp as claimed in claim 10 further comprising a reversing mechanism for moving the slide bar in the opposing direction.

16. A hand clamp as claimed in claim 15 wherein the reversing mechanism includes a backup lever positioned forward of the braking lever and having an aperture for receiving the slide bar 14 therethrough, the backup lever being movable between a position in which the backup lever frictionally engages the slide bar and a position wherein the backup lever does not frictionally engage the slide bar.

17. A hand clamp as claimed in claim 16 wherein the reversing mechanism further includes side extensions terminating in thumb tabs extending back towards the body on either side of the slide bar, and springs coupled between the side extensions and the body.

18. A hand clamp as claimed in claim 15 wherein the reversing mechanism comprises a second drive assembly for moving the slide bar in the opposing direction, the drive assembly including:

a second cavity formed in the body through which the slide bar extends;

a second driving lever carried within the second cavity and having an aperture through which the slide bar extends, the second driving lever movable between a first position providing substantially no frictional engagement with the slide bar and a second position frictionally engaging the slide bar and incrementally moving the slide bar in the opposing direction;

a second braking lever having a first end pivotally coupled to the body and a second end, the second braking lever being pivotable between a disengaged position substantially perpendicular to the slide bar and an engaged position wherein a frictional engagement occurs between the second braking lever and the slide bar preventing the slide bar from moving in the single direction.

19. A hand clamp as claimed in claim 18 where in the reversing mechanism further includes a selector switch having a first position in which the second braking lever is moved to the disengaged position and the second driving lever is moved from frictional engagement with the slide bar, and a second position in which the braking lever is moved to the disengaged position and the driving lever is moved from frictional engagement with the slide bar.

20. A hand clamp comprising:

a slide bar having a first end and a second end;

a first jaw coupled to the first end;

a body slidably receiving the slide bar, the body including a second jaw opposing the first jaw;

a first drive assembly for moving the slide bar in a single first direction, the drive assembly including:

a first cavity formed in the body through which the slide bar extends;

a first driving lever carried within the first cavity and having an aperture through which the slide bar extends, the drive bar movable between a first position providing substantially no frictional engagement with the slide bar and a second position frictionally engaging the slide bar and incrementally moving the slide bar in the single first direction; and a first braking lever having a first end pivotally coupled to the body, the first braking lever being pivotable between a disengaged position substantially perpendicular to the slide bar and an engaged position wherein a frictional engagement occurs between the first braking lever and the slide bar, preventing the slide bar from moving in a second direction opposite the first direction;

a second drive assembly for moving the slide bar in the single second direction, the drive assembly including:

a second cavity formed in the body through which the slide bar extends;

a second driving lever carried within the second cavity and having an aperture through which the slide bar extends, the second driving lever movable between a first position providing substantially no frictional engagement with the slide bar and a second position frictionally engaging the slide bar and incrementally moving the slide bar in the second direction;

a second braking lever having a first end pivotally coupled to the body and a second end, the second braking lever being pivotable between a disengaged position substantially perpendicular to the slide bar and an engaged position wherein a frictional engagement occurs between the second braking lever and the slide bar preventing the slide bar from moving in the single first direction; and a trigger handle pivotally coupled to the body and engaging the driving lever for moving the driving lever between the first position and the second position.

* * * * *